US005368406A

United States Patent [19]

Hanshaw

[11] Patent Number: 5,368,406

[45] Date of Patent: Nov. 29, 1994

[54] PEN-TYPE DEVICE WITH COMBINATION LOCK

[76] Inventor: Paul C. Hanshaw, Woodpeckers, Ford Lane, East Hendred, Wantage, Oxfordshire OX12 8LS, Great Britain

[21] Appl. No.: 972,455

[22] PCT Filed: Aug. 1, 1991

[86] PCT No.: PCT/GB91/01316

§ 371 Date: Feb. 1, 1993

§ 102(e) Date: Feb. 1, 1993

[87] PCT Pub. No.: WO92/02375

PCT Pub. Date: Feb. 20, 1992

[30] Foreign Application Priority Data

Aug. 1, 1990 [GB] United Kingdom ..... 9016878.2

[51] Int. Cl.[5] ..... B43K 29/00

[52] U.S. Cl. ..... 401/195; 70/58; 70/61; 401/99; 401/109

[58] Field of Search ..... 70/58, 61; 401/195, 401/99, 109

[56] References Cited

U.S. PATENT DOCUMENTS

| | | | |
|---|---|---|---|
| 3,354,675 | 11/1967 | Quigg | 70/58 |
| 3,679,317 | 7/1972 | Larson . | |
| 3,684,117 | 8/1972 | Leopoldi et al. | |
| 4,267,715 | 5/1981 | Aylesworth | 70/58 |
| 4,970,883 | 11/1990 | Johnson | 70/58 X |

FOREIGN PATENT DOCUMENTS

| | | | |
|---|---|---|---|
| 957118 | 2/1950 | France | 70/58 |
| 319122 | 1/1919 | Germany | 70/58 |
| 1561784 | 7/1970 | Germany | 401/195 |
| 252660 | 1/1948 | Switzerland | 70/58 |
| 11126 | of 1910 | United Kingdom | 70/58 |
| 12402 | of 1911 | United Kingdom | 70/58 |

*Primary Examiner*—Steven A. Bratlie
*Attorney, Agent, or Firm*—Vidas, Arrett & Steinkraus

[57] ABSTRACT

A pen-type device utilizing a combination type lock that operatively engages or releases an actuating member which is constructed and arranged to hold a replaceable element such as a ball point pen refill insert or pill dispenser.

8 Claims, 2 Drawing Sheets

PEN-TYPE DEVICE WITH COMBINATION LOCK

This invention relates to what will be referred to in this description as pen-type devices. A pen-type device here means a device suitable to be used in the hand, and having an elongate hollow body and actuating means whereby some kind of element, contained in the body, can be moved to a released position in which it at least protrudes from an aperture in the body.

The above definition includes devices in which the contained element is a part of the device itself, optionally a replaceable part, which is retractable into and out of the body between a working position and a retracted position.

In this form, the device is in general an instrument or tool. Thus, the element which is movable in the body may for example be a knife blade. More commonly, however, it is a writing instrument, the movable element being a writing element. Such a writing instrument may for example be a ball point pen or a pencil, the writing element then being a ball pen refill or a lead holder, respectively.

The above definition does however also include devices in the form of dispensing containers, where the contained elements consist of products stored in the container and intended to be dispensed one at a time. A typical example of this latter application is a pen-shaped pill dispenser for dispensing medicinal pills, sweetener tablets etc. Such pen-type dispensers are known for the use of travellers, for carrying in the pocket like a pen, or in a handbag.

The contents of a pill dispenser may be dangerous if they fall into the wrong hands. Pens and pencils tend to be borrowed and not returned. Accordingly, one object of the invention is to provide a pen-type device, as defined above, which incorporates a security device which can make it inconvenient or difficult or impossible for the device to be used by anyone other than the rightful user.

A retractable instrument or tool such as a pen or knife, when carried in the user's pocket or handbag, for example, can be dangerous or can cause damage if the retractable element, e.g. pen tip or blade, inadvertently becomes released from its retracted position. This problem is addressed in the patent document U.S. Pat. No. 3,679,317 (Larson), which describes an ordinary retractable ball-point pen with a lock to prevent its inadvertent release. The lock works on a rotary basis, in that its operation depends on rotation of the finger button to release the latter. The lock has only two positions, locked and unlocked, and has no feature that guards against unauthorised use.

Another object of the invention is to give security against inadvertent release together with protection against unauthorised use.

There is a large market for what are called premium gifts, presented by business people, as a form of advertising, to potential customers or others. In this field a well-known type of gift is a ball-point pen bearing advertising matter. It is a matter of opinion whether this form of advertising, being somewhat passive from the recipient's point of view, is truly effective. An attractive and useful gift that draws the user's attention to the advertiser in a more positive way may be more likely to attract the user's custom. Accordingly a further object of the invention is to provide a device that can fulfil this function.

According to the invention, a device having a hollow elongate body and actuating means whereby an element contained within the body can be moved to a released position in which the said element at least protrudes from an aperture in the body, is characterised by a combination-type lock. The lock includes a retaining member, movable with the actuating means, and ring means comprising at least one coded finger ring mounted for rotation around the body, the retaining member and ring means having cooperating first and second locking means respectively for locking the retaining member in a retracted position. The locking means is movable to a pre-coded released position when the ring means are set to a predetermined rotational configuration thereby releasing the elements.

The device may be an instrument or tool in which the said element is part of the device itslf, typically a writing instrument. The finger rings can then be marked with characters such as lettering spelling out (in the release or unlocking position) a message such as the name of a company; or part of the logo of a company may be marked on each ring, such that when they are all correctly positioned the whole logo appears. The markings on the rings may however be in any desired form, for example numerals, such that the lock can only be released when, in the usual manner of a combination lock, the correct (randomly chosen) combination is known to the user, thus giving protection against unauthorised use and making theft less attractive.

In addition, the invention prevents inadvertent release of the pen tip, knife blade or contents of the device.

Two embodiments of the invention, in the form of a retractable ball point pen, will now be described, by way of example only and with reference to the accompanying drawings, in which.

Figure 1:
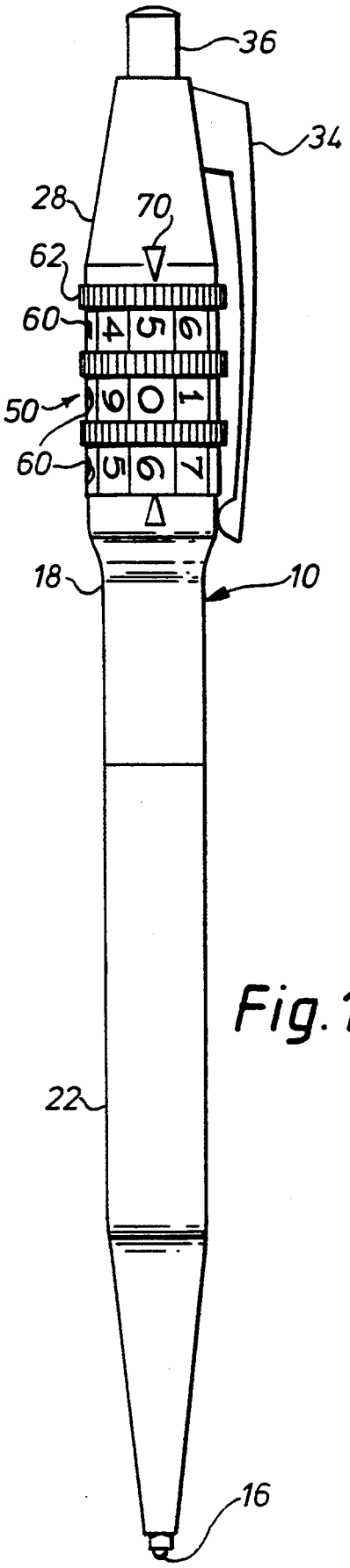
FIG. 1 is an outside view of the pen in a first form.
Figure 2:
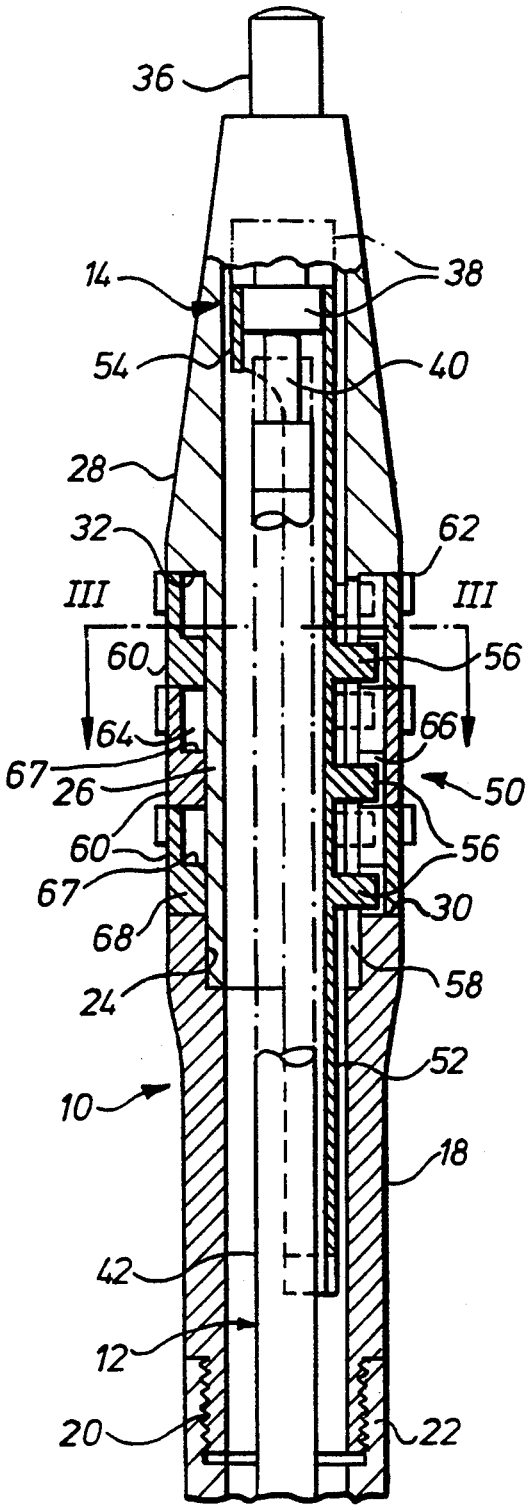
FIG. 2 is a longitudinal view, mostly in diametral cross section, of the upper part of the same pen.
Figure 3:
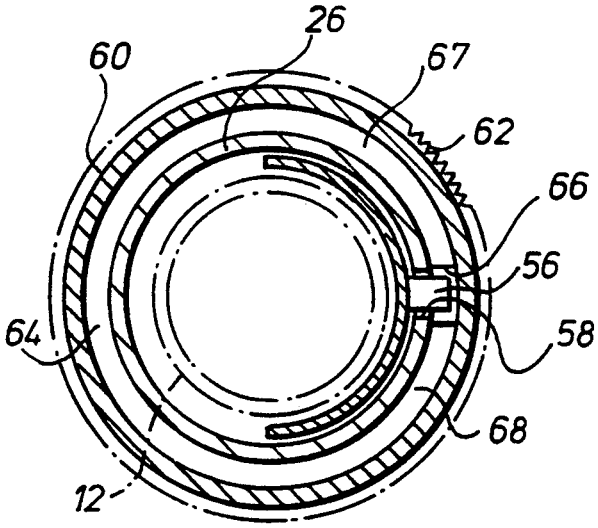
FIG. 3 is a transverse cross section on a larger scale, taken on the line III—III in FIG. 2.

The pen shown in FIGS. 1 to 3 has a hollow tubular body 10, a writing element 12, in the form of an ordinary ball point refill, in the body, and actuating means 14 for moving the refill 12 between its advanced or writing position, seen in FIG. 1, and a retracted position in which the writing tip 16 of the refill lies within the body 10.

The body 10 comprises an intermediate barrel member 18 having a conventional threaded connection 20 at its lower end for the removable attachment of a main barrel or nose piece 22, which contains the usual spring (not shown) for supporting the lower part of the refill 12 laterally and for returning it to its retracted position when permitted to do so by the actuating means 14.

The upper end of the barrel member 18 has a coaxial rebate 24 into which a thin-walled cylindrical extension 26 of an upper barrel member 28 is force-fitted. Radially outside the extension portion 26, the intermediate barrel member 18 has an upper shoulder 30 which is spaced from a facing lower shoulder 32 of the upper barrel member 28. The latter may carry a conventional pen clip 34, and contains the actuating means 14, which can be of any suitable type. In this example, it comprises a push button 36 arranged to move a pusher plate 38, lying approximately coaxially within the barrel member 28, between the advanced position shown in full lines in FIG. 2 and the retracted position shown in phantom lines, each push of the button actuating a conventional ratchet device to bring about a change from the current position of the plate 38 to its other position.

As shown, the refill 12 is of the kind having a spigot 40 closing the upper end of its ink tube 42, with the spigot 40 being held against the pusher plate 38 by the spring in the nose piece 22, so that when the pusher plate 38 is retracted the refill follows, and when the pusher plate is advanced the writing tip 16 is advanced to its writing position in which it projects from the body 10.

The pen incorporates a combination lock generally indicated at 50. This comprises a retaining member 52, cylindrical at its upper end 54, which is force fitted around the pusher plate 38 so as to move axially with the latter. The member 52 may be in any convenient shape such as a complete cylinder: as shown, it is cut away below the plate 38 to form a half cylinder lying closely within the bore of the barrel 28, 18. This shape gives it some strength and rigidity. It carries three projecting elements 56, all extending radially outwards through a longitudinal slot 58 in the extension 26 of the upper barrel member. Elements 56 may be in the form of flat plate-like teeth as shown, or round pins, or of any other suitable shape. They may be separate from the member 52 but secured to it, instead of integral as shown.

Apart from the retaining member 52, the lock 50 includes ring means consisting of three finger rings 60, stacked coaxially on the extension 26 so as to be freely rotatable on the latter. The endmost rings 60 lie against the shoulders 30 and 32 respectively, but are rotatable with respect to these shoulders. On its outer surface, each ring 60 has ten sections numbered 0 to 9, and may have a knurled finger portion 62. Internally, each ring 60 is relieved over part of its length by an annular rebate 64 defining an upwardly or rearwardly facing radial shoulder 67 on the unrelieved portion 68, through which a longitudinal slot 66, slightly wider than the circumferential width of one tooth element 56, is formed. Each slot 66 lies directly radially inward of one of the numbered sections on the outside of the corresponding ring: as to which one, this is selected randomly during manufacture, and this of course determines the combination which will allow the lock to be opened.

In the retracted position, the teeth elements 56, as shown in FIG. 2 in phantom lines, lie in the annular rebates 64, and the rings 60 can be freely rotated. The shoulders 67 of the ring portions 68 prevent the teeth element 56 from being moved forward, and therefore prevent the button 36 being operated to advance the writing tip 16 to its writing position. When the rings 60 are rotated to give the correct combination, the slots 66 are aligned with each other, so that depression of the button 36 then allows the teeth elements 56 to be moved forward into the slots 66 as shown in FIG. 2. The button 36 can then be operated to push the tip 16 to its writing position, and the pen is ready for use.

The retaining member 52 thus has a first locking means (here the teeth elements 56) cooperating with second locking means of the rings 60, namely in this example the shoulders 67 and slots 66, first to lock the retaining member 52 in its retracted position, and then to unlock it for forward movement to the released or writing position when the rings 60 are set to the predetermined rotational configuration defined by the correct combination.

The position of the relevant combination may be indicated by arrows on the outside of the body 10, as indicated at 70 in FIG. 1.

Figure 4:
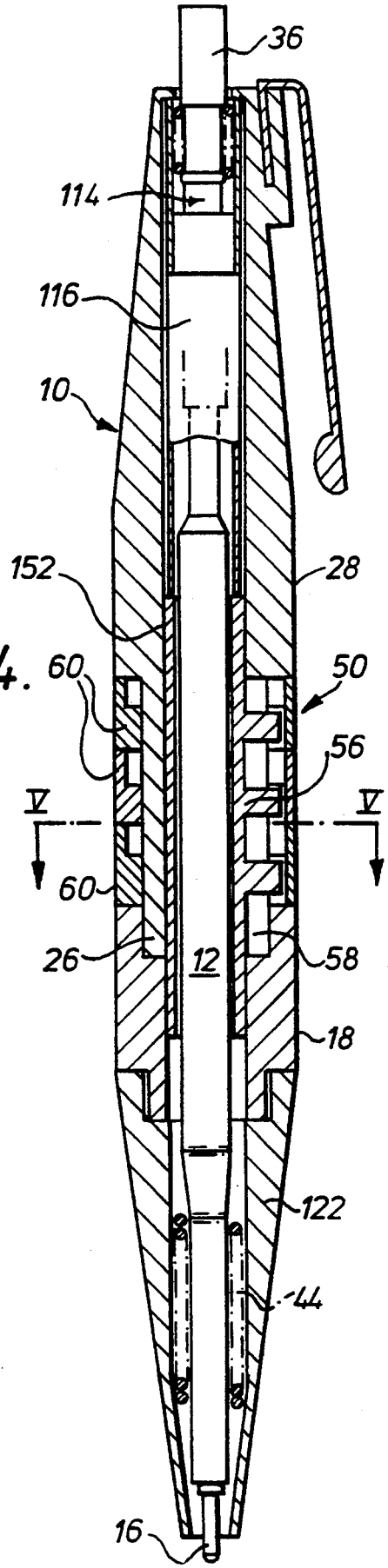
FIG. 4 is a longitudinal sectional view but showing the pen in a second form.
Figure 6:
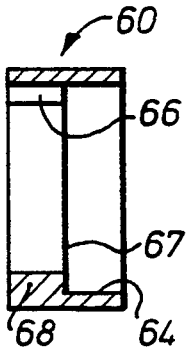
FIG. 6 is a cross section, on the line VI—VI in FIG. 5, of one component of the pen.
Figure 5:
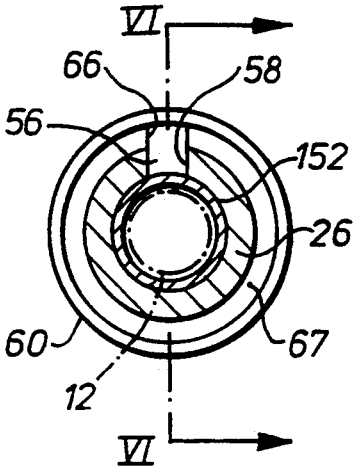
FIG. 5 is a cross section on the line V—V in FIG. 4.

The modified pen shown in FIGS. 4 to 6 has a conventional push button actuator 114 which has a tubular extension 116 that bears directly on the upper end of the retaining member 152. The latter is a simple tube with each tooth element 56 projecting radially from it as before, through the slot 58 and into the rebate 64 of the corresponding finger ring 60. The return spring is indicated at 44 in FIG. 4, within a relatively short nose piece 122.

FIGS. 5 and 6 show one of the finger rings 60 in detail, with FIG. 5 also showing how, in this embodiment, the tubular member 152 is a sliding fit in the barrel extension 26.

At least one of the rings 60 may be a "dummy", which may be achieved simply by omitting the corresponding tooth element 56 from the retaining member 52 or 152, provided the latter has at least one tooth so that at least one ring 60 is not a dummy.

Instead of being a pen, the pen-type device described above in its various forms may be a pencil or other type of writing or marking instrument, or a different type of instrument or tool such as a knife with a small retractable blade. The hollow space within its body may, in another modification, be arranged to contain medicinal or other tablets or a liquid, to be dispensed through an aperture such as that formed in the body at its front end (opposite to the button 36). In this latter case, the retaining member 52 (or 152 in the embodiment of FIGS. 4–6) is connected to a suitable dispensing device (of any known type) carried in the body for releasing a tablet or a quantity of liquid when the button 36 is depressed, after the correct combination has been set so as to allow this to be done.

I claim:

1. A device having a hollow elongate body (10), actuating means (14, 114, 44), and a contained element (12) contained within the body which can be moved by the actuating means to a released position in which at least a portion of the said contained element (12) protrudes from an aperture in the body (10), the elongate body (10) including thereon a combination-type lock (50) comprising a retaining member (52, 152), movable with the actuating means, (14, 114, 44), and ring means comprising at least one coded finger ring (60) mounted for rotation around the body (10), the retaining member and ring means having cooperative first and second locking means (56, 67, 66) respectively for locking the retaining member in a retracted position, and for unlocking the retainer member to permit operation of the actuating means (14, 114, 44) for movement of the contained element (12) to the released position when the ring means are set to a predetermined rotational configuration.

2. A device according to claim 1, wherein the first locking means comprise at least one element (56) projecting generally radially outwards from the retaining member (52, 152), and the second locking means comprise a longitudinal slot (66) formed in the ring means (60) to cooperate with each said projecting element (56), to allow the latter to move longitudinally, and a shoulder (67) of the ring means terminating the or each said slot (66) for retaining the cooperating projecting element (56) in the axial direction.

3. A device according to claim 2, wherein the retaining member (52, 152) is an axially extending element having the said projecting element or elements (56) extending from it.

4. A device according to claim 3, wherein that the ring means (60) are mounted on the body (10) for free rotation thereon, the retaining member (52, 152) being carried within the body and the body having a longitudinal slot (58) through which the or each projecting locking element (56) of the retaining member extends for sliding movement along the slot (58).

5. A device according to claim 1 in which the ring means consists of a plurality of finger rings (60), wherein each finger ring has a said second locking means (67, 66).

6. A device according to claim 1, being an instrument including the said element (12) contained within the body (10) as part of the device, wherein that the actuating means (14) is adapted to move the said element forward so that a tip (16) of the element (12) protrudes from the body.

7. A device according to claim 6, the actuating means includes return means (44) for returning the said element (12) and the retaining means (52, 152) to the retracted position.

8. A device according to claim 6, being a writing instrument wherein the said element is a writing element (12).

* * * * *